US005868334A

United States Patent [19]

Cedillo

[11] Patent Number: 5,868,334

[45] Date of Patent: Feb. 9, 1999

[54] LIGHT HANGING EXTENSION DEVICE AND METHOD FOR USING SAME

[76] Inventor: Armando Cedillo, 178 S. Lyle, Elgin, Ill. 60123

[21] Appl. No.: 688,759

[22] Filed: Jul. 31, 1996

[51] Int. Cl.[6] ..... B65H 75/40

[52] U.S. Cl. ..... 242/405.3; 206/420; 242/571.5

[58] Field of Search ..... 242/395, 395.1, 242/405, 405.3, 402, 588.2, 571.4, 571.5, 588; 206/702, 389, 419, 420; 156/577; 29/433, 241

[56] References Cited

U.S. PATENT DOCUMENTS

| | | | |
|---|---|---|---|
| D. 339,976 | 10/1993 | Ferguson, Sr. . | |
| D. 340,846 | 11/1993 | Nichols, Jr. . | |
| 1,226,929 | 5/1917 | Updike | 242/588.2 |
| 3,983,977 | 10/1976 | Crabb . | |
| 4,014,477 | 3/1977 | Hyun | 242/405.3 |
| 4,493,461 | 1/1985 | Polanco et al. . | |
| 4,722,493 | 2/1988 | Parry et al. | 242/588.2 |
| 4,917,323 | 4/1990 | Wing . | |
| 4,953,810 | 9/1990 | Stadig . | |
| 5,186,411 | 2/1993 | Fanning et al. . | |
| 5,287,965 | 2/1994 | Miller . | |
| 5,328,543 | 7/1994 | Campagna | 156/577 |
| 5,482,226 | 1/1996 | Choate | 242/588 |
| 5,526,931 | 6/1996 | White | 206/420 |
| 5,570,564 | 11/1996 | Moore et al. | 242/571.4 |
| 5,598,985 | 2/1997 | Winesett | 242/395 |
| 5,661,953 | 9/1997 | Jolley | 53/430 |

*Primary Examiner*—John M. Jillions
*Attorney, Agent, or Firm*—Meroni & Meroni

[57] ABSTRACT

A device for storing and hanging a continuous string of lights on a tree is provided. The device includes a spool assembly having first and second annular plates spaced apart and connected to a cylinder member. One of the annular plates is adapted to releasably secure an end portion of the string of lights in a fixed position. An axle structure is removably secured within a bore of the cylinder member. The axle structure has a holding mechanism for releasably securing the axle structure to the cylinder member. A handle is coaxially mounted to the axle structure. An elongated pole is provided which has first and second end portions. The first end portion is removably coaxially secured to the handle. The elongated pole is sized for extending and elevating the spool assembly upwardly in close adjacency with branches of the tree when a user grasps the second end portion of the elongated pole so that the spool assembly can be moved around a perimeter of the tree to enable the string of lights of be progressively strung about the tree to adorn the tree with the string of lights.

9 Claims, 4 Drawing Sheets

Fig. 1
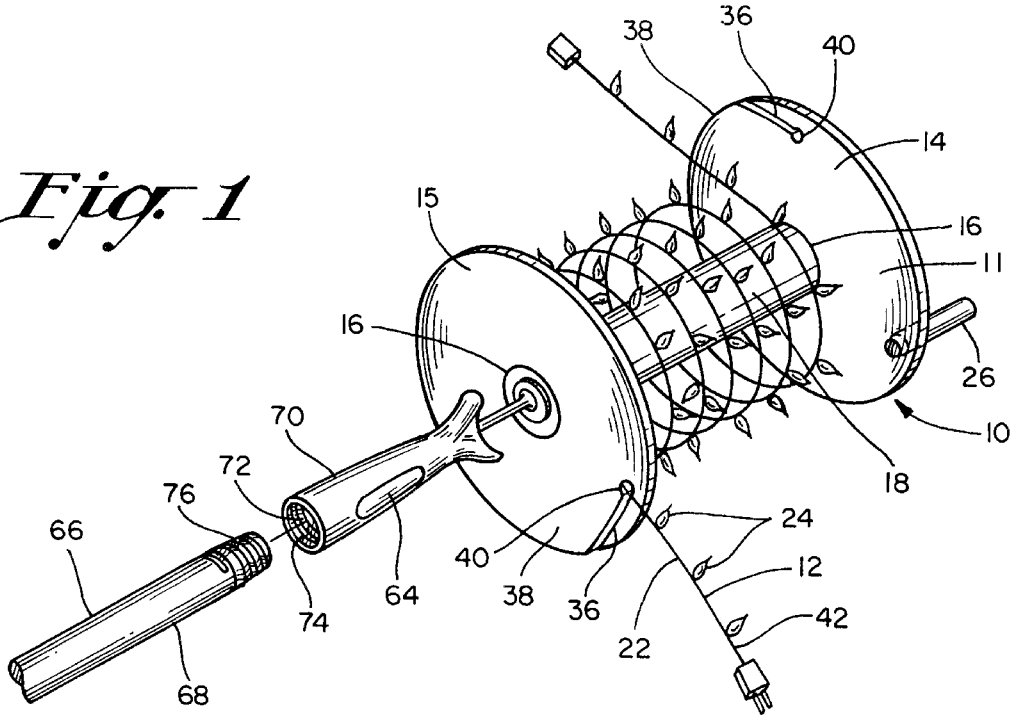
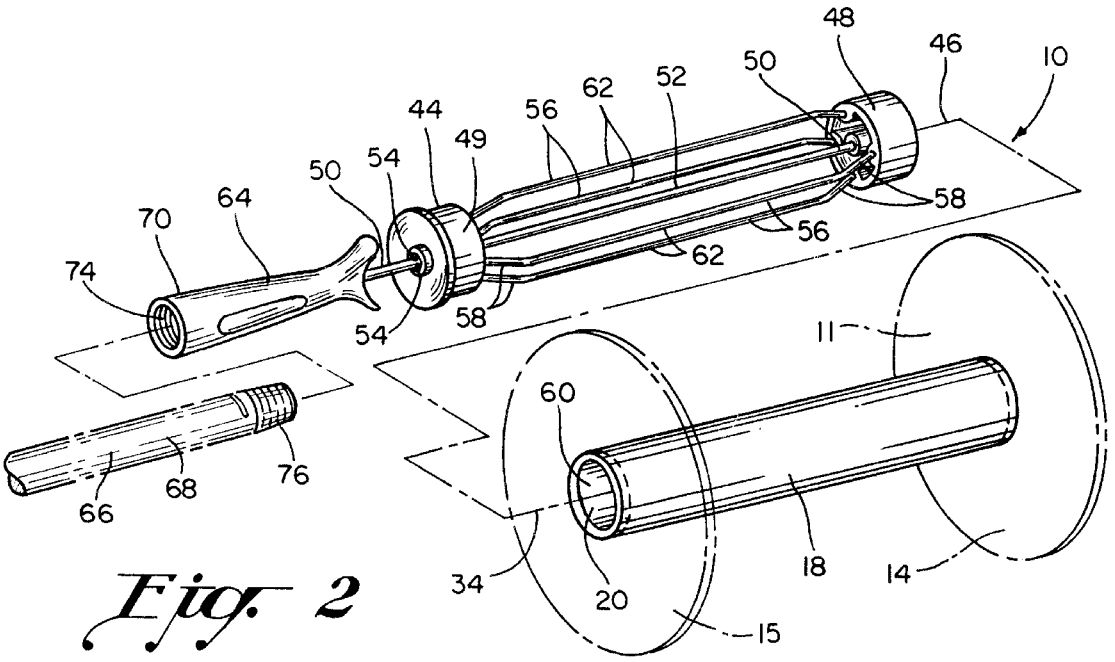
Fig. 2

LIGHT HANGING EXTENSION DEVICE AND METHOD FOR USING SAME

BACKGROUND OF THE INVENTION

1. Field of the Invention

The present invention relates generally to storing and hanging devices for lights. More particularly, the invention pertains to a storing and hanging extension device and method for using same for use with a continuous string of lights in the adornment of trees.

2. Description of the Prior Art

The adornment of trees with strings of electric lights is especially popular with those who celebrate Christmas where a decorated Christmas tree is desired, as well as for those seeking to provide a decorated tree for other festive events.

As decorative and aesthetically pleasing as these lights can be, storage, installation and removal of such lights is commonly viewed as both problematic and tedious. Once removed from their packages, the electric lights are highly prone to becoming tangled, which poses both storage and installation difficulties.

A common manner of tree decoration requires strings of lights to be continuously strung from the very top of the tree to the bottom, often in a spiral type configuration. Installing the lights on the upper boughs or branches of trees, such as evergreen trees is both time consuming and dangerous, as it typically requires the use of a ladder. The level of danger to an installer is further increased when having to decorate taller trees or in northern climates where such activity often occurs in winter where snow and ice may be covering the trees and ground and where the user has to repeatably climb a ladder in cold temperatures wearing bulking clothing, which both increases the likelihood of the installer falling from the ladder and the amount of time needed to hang the lights.

As will be described in greater detail hereinafter, the method and device of the present invention differs from those previously proposed and employs a number of novel features that solve the above mentioned problems and render it highly advantageous over the prior art.

SUMMARY OF THE INVENTION

Accordingly, it is an object of this invention to provide a device and method for storing and hanging a continuous string of lights on a tree which solves the aforementioned problems.

Another object of this invention is to provide a device that can be inexpensively manufactured and is safe, easy to use, and efficient.

Still another object of this invention is to provide a device which will prevent light breakage in that the lights will be stored and installed in an orderly manner which prevents entanglement.

To achieve the foregoing and other objectives, and in accordance with the purposes of the present invention a device for storing and hanging a continuous string of lights on a tree is provided. The device includes a spool assembly having first and second annular plates spaced apart and connected to a cylinder member. The spool assembly is sized for storing a coiled continuous string of lights. One of the annular plates is provided with means to releasably secure an end portion of the string of lights in fixed position to ensure the string of lights remains in a tightly wound position and to prevent unraveling of the string of lights on the spool assembly when the spool assembly is being stored. An axle structure is removably secured within a bore of the cylinder member. The axle structure is adapted for rotation of the spool along a longitudinal axis of the axle structure. The axle structure has a holding mechanism for releasably securing the axle structure to the cylinder member. A handle is coaxially mounted to the axle structure. An elongated pole is provided which has first and second end portions. The first end portion is removably coaxially secured to the handle. The elongated pole is sized for extending and elevating the spool assembly upwardly in close adjacency with branches of the tree when a user grasps the second end portion of the elongated pole so that the spool assembly can be moved around a perimeter of the tree to enable the string of lights of be progressively strung about the tree to adorn the tree with the string of lights.

In accordance with a method of adorning a tree with a continuous string of lights where the string of lights are coiled about a spool assembly, and the spool assembly is removably mounted to an axle structure for rotation of spool assembly about its longitudinal axis, the method includes the following the steps: freeing one end of the continuous string of lights from the spool assembly; elevating and positioning the one end of the string of lights within branches of the tree; elevating the spool assembly with a pole attached to the axle structure for positioning the spool assembly remote from a user and in close adjacency with the branches of the tree, the longitudinal axis of the spool assembly being generally vertically oriented; and moving the spool about a perimeter of the tree so that tension produced by the one end of the string of lights positioned within the branches against the spool assembly causes rotation of the spool assembly to progressively free the string of lights from the spool assembly for positioning within the branches of the tree so that the branches provide support to hold the string of lights in relatively secured position.

Other objects, features and advantages of the invention will become more readily apparent upon reference to the following description when taken in conjunction with the accompanying drawings, which drawings illustrate several embodiments of the invention.

BRIEF DESCRIPTION OF THE DRAWINGS

In the drawings:

FIG. 1 is a perspective view of the present invention;

FIG. 2 is an exploded perspective view of the present invention;

DETAILED DESCRIPTION OF THE PREFERRED EMBODIMENT

Figure 3:
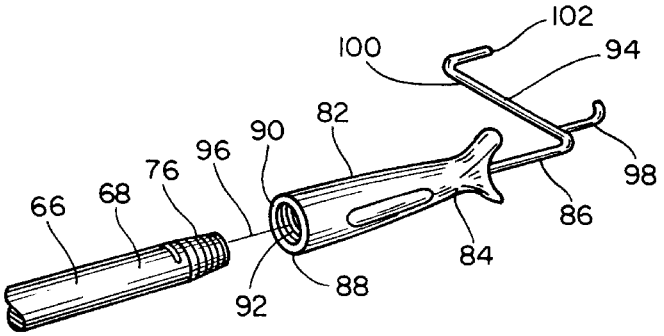
FIG. 3 is a perspective view of a tool for use with the present invention.

Referring now to the drawings, a storage and dispensing extension device 10 for storing and hanging a continuous string of lights 12 on a tree is illustrated in FIGS. 1 and 2.

The device 10 includes a spool assembly or structure 11. The spool assembly 11 has first and second annular plates or sections 14, 15 in a spaced apart relationship and connected to opposite ends 16 of an elongated cylinder member or axial section 18. The cylinder member 18 has a bore 20 extending axially therethrough. The spool assembly 11 is preferably formed synthetic plastic and is sized for storing a coiled continuous string of lights 12 positioned thereon. The string of lights 12 are preferably electric Christmas type lights which are comprised of an electric cord or line 22 having a plurality of light bulb and socket assemblies 24 connected with the line 22 along its length.

Figure 5:
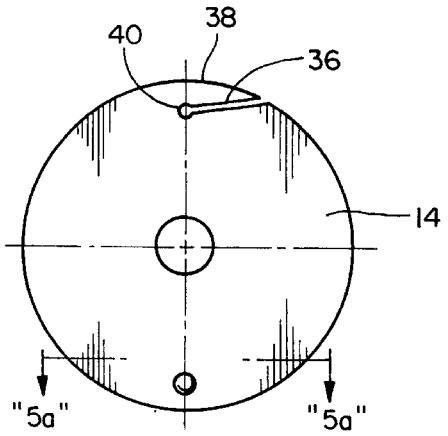
FIG. 5 is a second end view of the present invention.
Figure 5A:
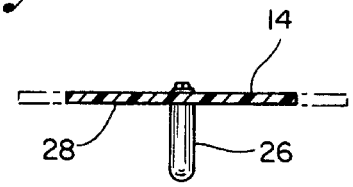
FIG. 5*a* is a sectional view taken along line 5*a*—5*a* of FIG. 5.

Referring to FIGS. 1, 5 and 5*a,* a winding handle 26 is secured to and extends perpendicularly from an outer surface 28 of the first annular plate 14. The winding handle is sized and adapted for grasping by a hand 30 of a user 32 (FIG. 9) to rotate the spool assembly 11 about its longitudinal axis 34.

Figure 4:
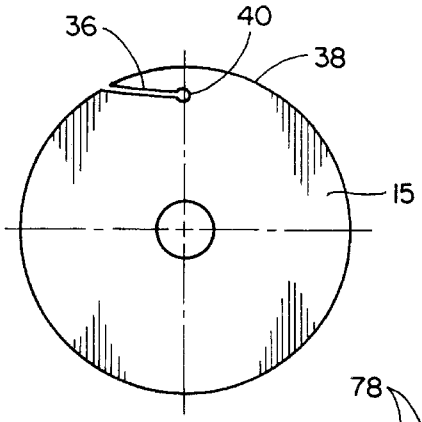
FIG. 4 is a first end view of the present invention.

Referring to FIGS. 1 and 4, at least one of the annular plates 14, 15 is provided with a slot 36 extending radially through an outer edge 38 of one of the annular plates 14, 15 and terminates in a circular hole 40 which extends axially through the annular plates 14, 15 to releasably secure an end or forward portion 42 (FIG. 1) of the string of lights 12 in a fixed position to ensure the string of lights 12 remains in a tightly wound position and to prevent unraveling of the string of lights 12 on the spool assembly 11 when the spool assembly 11 is being stored. The slot 36 and hole 40 are sized to allow the line 22 of the string of lights 12 to securely engage within, with the hole 40 having a slightly larger diameter than the slot 36 to assist in retaining the line 22 in place.

Referring to FIG. 2, an axle structure 44 is removably secured within the bore 20 of the cylinder member 18. The axle structure 44 is adapted for rotation of the spool assembly 11 along a longitudinal axis 46 of the axle structure 44. The axle structure 44 has first and second plastic end caps 48, 49 rotatably secured in a spaced apart relationship to opposite ends 50 of an elongated metal axle rod 52. The second end cap 49 is rotatably held in place on the axle rod 52 by indentions 54. A plurality of flexible and resilient wire members 56 having opposite wire ends 58 which are secured to the first and second end caps 48, 49. The wire members 56 are outwardly bowed relative to the axle rod 52 for removable pressing engagement with an interior surface 60 of the cylinder member 18 within the bore 20 where outwardly bowed portions 62 of the wire members 56 produce resilience to hold the axle structure 44 in operative engagement with the spool assembly 11.

Figure 9:
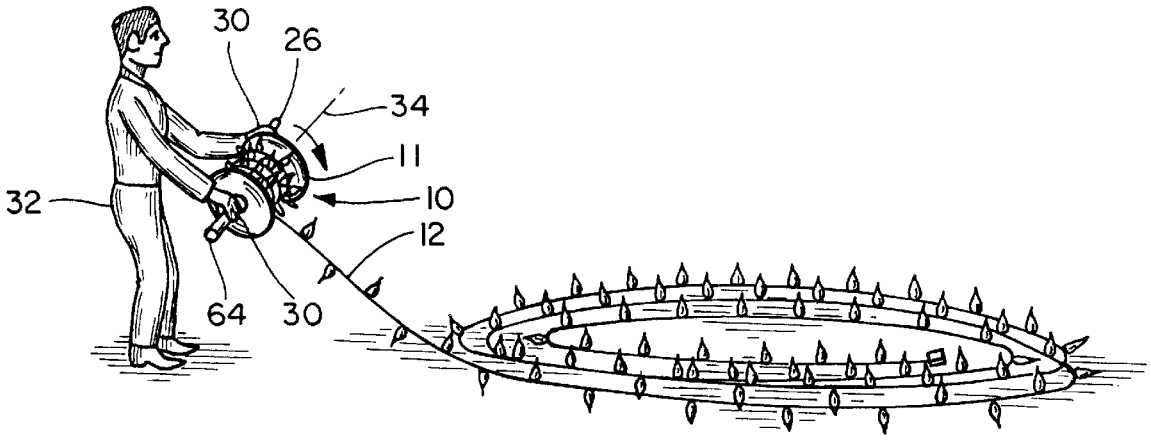
FIG. 9 is a diagrammatic perspective view illustrating the method of the present invention during winding up the string of lights on the spool assembly.

A handle 64 is coaxially mounted to the elongated axle rod 52 and outwardly extends from the spool assembly for grasping by a hand 30 of the user 32 (FIG. 9). An elongated pole 66 which can be comprised of any suitable number of end portions or sections as shown in the drawings where I have included five sections or end portions which have been identified as first and second end portions 68, 69. An end 70 of the handle 64 has an axial bore 72 with internal threaded surfaces 74 for removable threaded engagement with external threaded surfaces 76 of the first end portion 68 of the elongated pole 66 with the handle 64 and pole 66 being coaxially aligned. It should be noted that the handle provides a dual purpose in that it allow the user 32 to grasp it for operation of the spool assembly 11 at low heights and for winding up the string of lights 12 (FIG. 9) when a new string of lights 12 are first coiled on the spool assembly 11 or when storing the string of lights after having removed them from a tree 80.

The pole 66 is sized for extending and elevating the spool assembly 11 (FIG. 7) upwardly in close adjacency with branches 78 of the tree 80 when the user 32 grasps the second end portion 69 of the pole 66. The spool assembly 11 can then be moved around a perimeter of the tree 80 to enable the string of lights 12 of be progressively strung about the tree 80 to adorn the tree 80 with the string of lights 12. In a preferred embodiment, the pole 66 is formed of five pole segments 67 (FIG. 7) removably connected to one another in coaxial assembly.

Referring to FIG. 2, a tool 82 is provided for use with the spool assembly 11. The tool 82 has a handle 84 having an upright leg 86 extending therefrom. An end 88 of the handle 84 has an axial bore 90 with internal threaded surfaces 92 for removable threaded engagement with external threaded surfaces 76 of the first end portion 68 of the elongated pole 66 with the handle 84 and pole 66 being coaxially aligned. Therefore, the tool 82 is able to attach with the same pole 66 as used with the device 10 when the device 10 is not in use. An angular leg 94 is connected to the upright leg 86 and extends away from a vertical axis 96 through the handle 84. Extending above the angular leg 94 is a first upright leg member 98. Spaced apart from the member 98 at an outer end 100 of the angular leg 94 is a second upright leg member 102.

Figure 6:
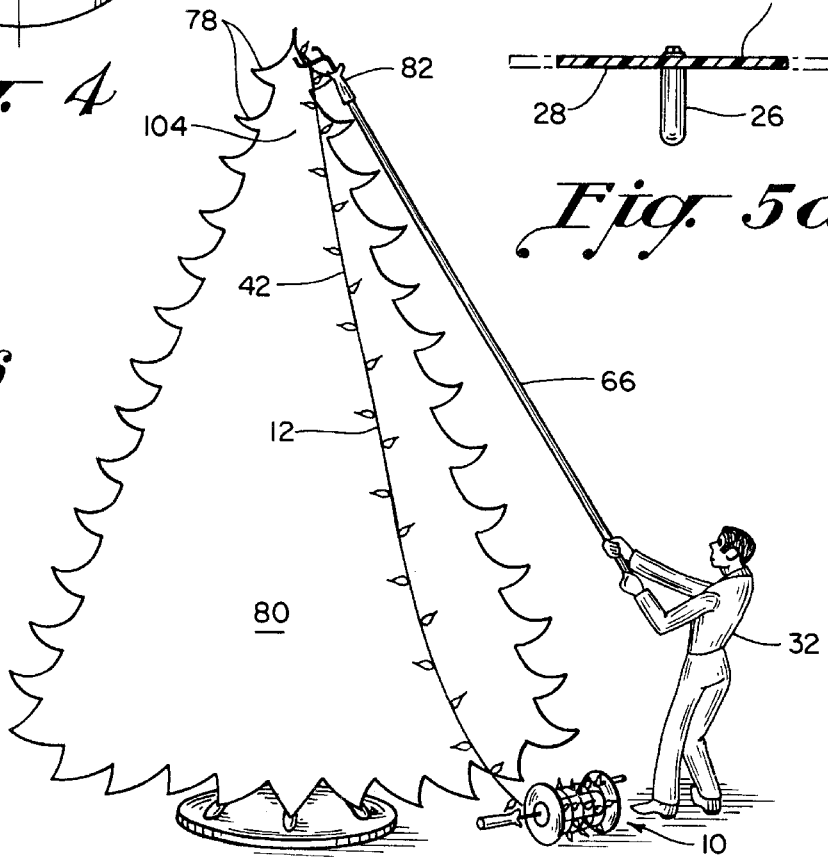
FIG. 6 is a diagrammatic perspective view illustrating the method of the present invention during installation of the forward end of a string of lights.

In use, the tool 82 is extendible on the pole 66 for elevating the one end 42 or a portion of the string of lights 12 extending across in resting engagement on the angular leg 94. The tool 82 is thereby allowed to be elevated in position remote from a user 32 grasping the second end portion 69 of the elongated pole 66 for placement of the angular leg 94 in immediate adjacency with the branches of the tree. The first and second upright leg members 98, 102 retain the lights 12 on the leg 94 until the one end 42 of the string of lights 12 is positioned within the branches allowing the tool 82 to be removed. the tool being extendible on the pole for elevating a portion of the string of lights extending across in resting engagement on the angular leg for In the method of adorning the tree 80 with the continuous string of lights 12, the first step requires freeing one end 42 of the continuous string of lights 12 from the spool assembly 11. The one end 42 of the string of lights 12 is then elevated and positioned within branches 78 of the tree 80, as shown in FIG. 6. To this degree, the tool 82 can be secured to the pole 66 as described above allowing the angular leg 94 and members 98, 102 to provide an open claw type configuration to hold the end 42 of the lights 12 allowing the tool 82 to position and secure the end 42 into a top portion 104 of the tree 80 as previously described.

Figure 7:
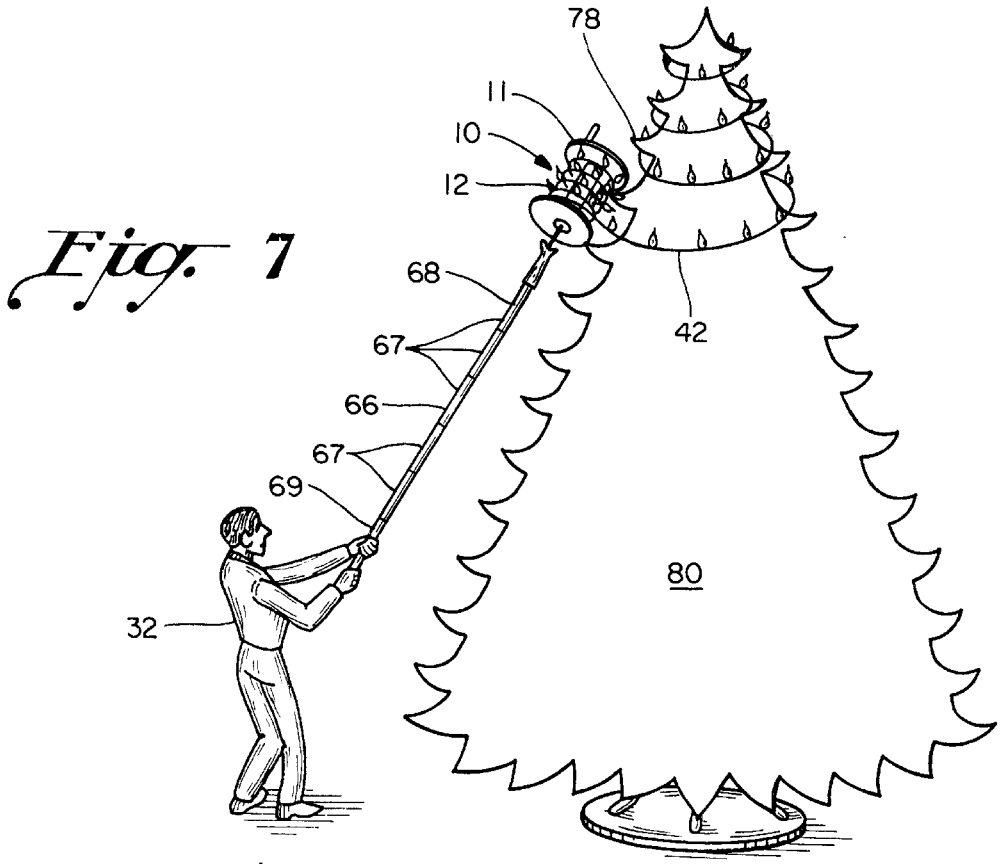
FIG. 7 is a diagrammatic perspective view illustrating the method of the present invention during installation of the string of lights.

The spool assembly 11 is then elevated with the pole 66, as shown in FIG. 7, for positioning the spool assembly 11 remote from the user 32 and in close adjacency with the upper branches 78 of the tree 80. The longitudinal axis of the spool assembly 11 is generally vertically oriented in this manner. Moving the spool assembly 11 about a perimeter of the tree 80, tension is thereby produced by the one end or secured portion 42 of the string of lights 12 being positioned and secured within the branches 78. This tension is produced against the spool assembly 11 causing rotation of the spool assembly 11 to progressively free the string of lights 12 from the spool assembly 11 for positioning within the branches 78 of the tree 80 as the user moves the device 10 about so that the branches 78 provide support to hold the string of lights 12 in relatively secured position.

Figure 8:
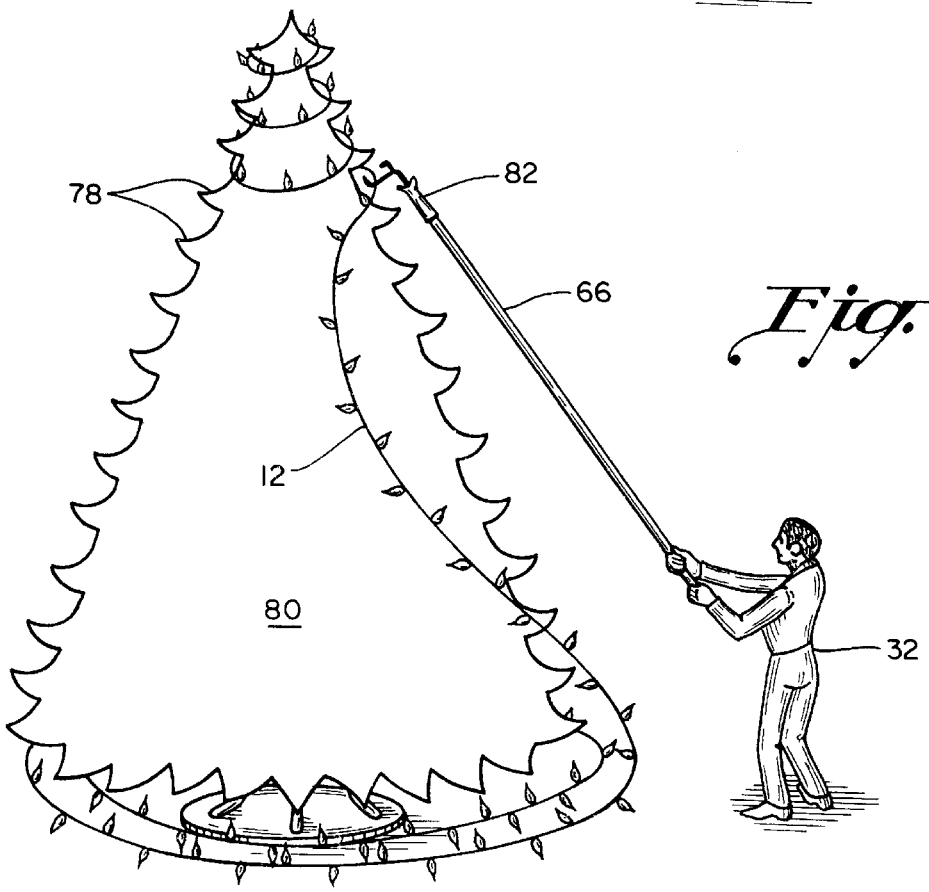
FIG. 8 is a diagrammatic perspective view illustrating the method of the present invention during removal of the string of lights.

In removal of the string of lights 12 from the tree 80, the tool 82 may be used as illustrated in FIG. 8, to lift and separate the lights 12 from the branches and lay the string of lights 12 on the ground about the tree 80. Once removed, the string of lights 12 can be recoiled upon the device 10 in the manner previously described and shown in FIG. 9. Once coiled, the string of lights 12 are not prone to entanglement and damage. Further, multiple spool assemblies can be provided for use with the axle assembly 44 and pole 66 where the removable spool assemblies can hold additional lights when having to decorate numerous trees, such as is common along city streets or at shopping malls.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A device for storing and hanging a continuous string of lights on a tree, the device comprising:

(a) a spool assembly having first and second annular plates spaced apart and connected to a cylinder member, the cylinder member having a bore extending axially therethrough, the spool assembly being sized for storing a coiled continuous string of lights positioned thereon;

(b) a winding handle secured to and extending from an outer surface of the first annular plate, the winding handle being adapted for grasping by a hand of the user to rotate the spool assembly about its longitudinal axis;

(c) means attached to one of said annular plates to releasably secure an end portion of the string of lights in fixed position to ensure the string of lights remains in a tightly wound position and to prevent unraveling of the string of lights on the spool assembly when the spool assembly is being stored, said means including a slot extending radially through an outer edge of one of said annular plates and terminating in a circular hole which extends axially through said one of said annular plates;

(d) an axle structure removably secured within the bore of the cylinder member, the axle structure being adapted for rotation of the spool assembly along a longitudinal axis of the axle structure, the axle structure having first and second end caps rotatably secured in a spaced apart relationship to opposite ends of an elongated axle rod, and a plurality of flexible wire members having opposite wire ends secured between the first and second end caps, the flexible wire members being outwardly bowed relative to a the elongated axle rod for removable pressing engagement with an interior surface of the cylinder member within the bore;

(e) a handle coaxially mounted to the elongated axle rod and outwardly extending therefrom; and (f) an elongated pole having first and second end portions, an end of the handle having an axial bore with internal threaded surfaces for removable threaded engagement with external threaded surfaces of the first end portion of the elongated pole, the handle and elongated pole being coaxially aligned, the elongated pole being sized for extending and elevating the spool assembly upwardly in close adjacency with branches of the tree when a user grasps the second end portion of the elongated pole so that the spool assembly can be moved around a perimeter of the tree to enable the string of lights to be progressively strung about the tree to adorn the tree with the string of lights.

2. A device for storing and hanging a continuous string of lights on a tree, the device comprising:

(a) a spool assembly having first and second annular plates spaced apart and connected to a cylinder member, the cylinder member having a bore extending axially therethrough, the spool assembly being sized for storing a coiled continuous string of lights positioned thereon;

(b) means attached to one of said annular plates to releasably secure an end portion of the string of lights in fixed position to ensure the string of lights remains in a tightly wound position and to prevent unraveling of the string of lights on the spool assembly when the spool assembly is being stored;

(c) an axle structure removably secured within the bore of the cylinder member, the axle structure being adapted for rotation of the spool assembly along a longitudinal axis of the axle structure, the axle structure having holding means for releasably securing the axle structure to the cylinder member;

(d) a handle coaxially mounted to the axle structure and outwardly extending therefrom; and (e) an elongated pole having first and second end portions, the first end portion being removably coaxially secured to the handle, the elongated pole being sized for extending and elevating the spool assembly upwardly in close adjacency with branches of the tree when a user grasps the second end portion of the elongated pole so that the spool assembly can be moved around a perimeter of the tree to enable the string of lights of be progressively strung about the tree to adorn the tree with the string of lights.

3. The device of claim 2, further comprising a winding handle secured to and extending from an outer surface of the first annular plate, the winding handle being adapted for grasping by a hand of the user to rotate the spool assembly about the longitudinal axis of the axle structure.

4. The device of claim 3, wherein the means attached to one of said annular plates to releasably secure an end portion of the string of lights in fixed position includes a slot extending radially through an outer edge of one of said annular plates and terminating in a circular hole which extends axially through said one of said annular plates.

5. The device of claim 2, wherein an end of the handle has an axial bore having internal threaded surfaces for threaded engagement with external threaded surfaces of the first end portion of the elongated pole.

6. The device of claim 2, wherein the axle structure includes first and second end caps rotatably secured in a spaced apart relationship to opposite ends of an elongated axle rod, the holding means for releasably securing the axle structure to the cylinder member includes a plurality of flexible wire members having opposite wire ends secured between the first and second end caps, the flexible wire members being outwardly bowed relative to a the elongated axle rod for removable pressing engagement with an interior surface of the cylinder member within the bore.

7. The method of adorning a tree with a continuous string of lights, the string of lights being coiled about a spool assembly, the spool assembly being removably mounted to an axle structure for rotation of spool assembly about its longitudinal axis, the method comprising:

(a) freeing one end of the continuous string of lights from the spool assembly;

(b) elevating and positioning the one end of the string of lights within branches of the tree;

(c) elevating the spool assembly with a pole attached to the axle structure for positioning the spool assembly remote from a user and in close adjacency with the branches of the tree, the longitudinal axis of the spool assembly being generally vertically oriented; and (d) moving the spool assembly about a perimeter of the tree so that tension produced by the one end of the string of lights positioned within the branches against the spool assembly causes rotation of the spool assembly to progressively free the string of lights from the spool assembly for positioning within the branches of the tree so that the branches provide support to hold the string of lights in relatively secured position.

8. The method of claim 7, wherein the step of elevating and positioning the one end of the string of lights within branches of the tree includes a tool having a handle removably connected coaxially with an elongated pole, the handle having an upright leg extending therefrom, an angular leg connected to the upright leg extending away from a vertical axis of the handle, and first and second upright leg members extending vertically from the angular leg in a spaced apart relationship with one another, the tool being extendible on the pole for elevating the one end of the string of lights extending across in resting engagement on the angular leg whereby the one end of the string of lights is positioned within the branches allowing the tool to be removed.

9. A device for storing and hanging a continuous string of lights on a tree, the device comprising:

(a) a spool structure having a pair of spaced apart annular plate sections connected by an axial section, the axial section having a bore extending axially therethrough, the spool structure being sized for storing a coiled continuous string of lights positioned thereon;

(b) an axle structure removably secured within the bore of the axial section, the axle structure being adapted for rotation of the spool structure along a longitudinal axis of the axle structure, the axle structure having holding means for releasably securing the axle structure to the axial section;

(c) a handle coaxially mounted to the axle structure and outwardly extending therefrom; and (d) an elongated pole having first and second end portions, the first end portion being removably coaxially secured to the handle, the elongated pole being sized for extending and elevating the spool structure upwardly in close adjacency with branches of the tree when a user grasps the second end portion of the elongated pole so that the spool structure can be moved around a perimeter of the tree to enable the string of lights of be progressively strung about the tree to adorn the tree with the string of lights.

* * * * *